United States Patent [19]

Diller

[11] Patent Number: 4,536,629

[45] Date of Patent: Aug. 20, 1985

[54] GAS DAMPED ACCELERATION SWITCH

[75] Inventor: Robert W. Diller, Pasadena, Calif.

[73] Assignee: Technar, Incorporated, Arcadia, Calif.

[21] Appl. No.: 548,337

[22] Filed: Nov. 3, 1983

[51] Int. Cl.[3] ..... H01H 35/14

[52] U.S. Cl. ..... 200/61.45 R; 200/61.53

[58] Field of Search ..... 200/61.45 R, 61.53; 180/282; 340/669, 670; 73/514, 517 R; 280/735

[56] References Cited

U.S. PATENT DOCUMENTS 4,097,699 6/1978 Larson ..... 200/61.45 R

*Primary Examiner*—G. P. Tolin
*Assistant Examiner*—Morris Ginsburg
*Attorney, Agent, or Firm*—Christie, Parker & Hale

[57] ABSTRACT

A gas damped acceleration switch for use as a vehicle crash-sensing device. A mass is supported for movement along an axis against a spring, the mass actuating a switch only after moving a predetermined distance against the spring by an accelerating force. A gas damping system makes the device sensitive to the duration as well as the magnitude of the velocity change. Damping is provided by a plate movable with the mass having surfaces that are perpendicular to the axis of motion. The plate is normally pressed against a mating surface to exclude air. A seal is formed between the mating surfaces around the periphery so that a partial vacuum is formed as the mass moves the surfaces apart. When the surfaces move apart a predetermined distance, the seal is broken and the pressure equalizes. However, the moving plate still produces viscous damping as a function of velocity as it continues to be moved through the air by acceleration of the mass against the spring.

14 Claims, 4 Drawing Figures

SWITCHING THRESHOLD AS A FUNCTION OF PULSE DURATION

GAS DAMPED ACCELERATION SWITCH

FIELD OF THE INVENTION

This invention relates to vehicle crash-sensing switches and, more particularly, to a gas damped acceleration switch.

BACKGROUND OF THE INVENTION

With the development of the air bag as a safety device for automobiles and other passenger vehicles, there has developed a need for a crash-sensing device for actuating the air bag inflater in a crash situation. This requires a detection device mounted on the vehicle for sensing a rapid change of velocity of the vehicle and actuating a switch when the deceleration is greater than a threshold amount. To be most effective, a crash-sensing device is preferably mounted at the front of a vehicle, such as on the front bumper where the change in velocity is most abrupt and acts with the minimum of time delay following the onset of a crash. At such locations, however, the device is exposed to other forces not connected with a crash situation but which may still be relatively large in magnitude. Thus the device must be direction sensitive, must be extremely rugged in construction, and must be able to discriminate both against high accelerations of very short duration to which the front of the vehicle is normally subjected, and discriminate against large velocity changes which nevertheless take place over a relatively long period of time, such as are experienced in emergency braking of the vehicle.

Crash-sensing devices using an inertial mass are known in the art. See, for example, U.S. Pat. Nos. 3,556,556 and 3,750,100. Inertial switches of the same general type have also been proposed which utilize the movement of an inertial mass under an acceleration or deceleration force. Such known devices have been used to sense acceleration but also, by means of fluid damping, have been used as velocimeters to respond to the integral of the acceleration. Fluid damping has been provided by enclosing the inertial mass in a closed chamber, the inertial mass acting as a piston dividing the chamber into two volumes. Any force acting on the piston is damped by the transfer of fluid from the decreasing volume side of the moving piston to the increasing volume side of the piston, as through a space around the piston or through a tubular passage between the two volumes. See U.S. Pat. Nos. 3,632,920 and 3,300,603.

In such piston-damped devices, the damping force as a function of velocity can be controlled by the nature of fluid flow passing through an orifice from the compression side to the vacuum side of the moving piston. Such conventional damped acceleration switches require a very high manufacturing tolerance to achieve the characteristics necessary to make them effective as crash-sensing devices. Such piston devices have also exhibited poor reliability and inconsistent performance with changes in temperature.

SUMMARY OF THE INVENTION

The present invention provides a crash-sensing switch which shows maximum sensitivity to the impulse characteristic of a crash situation while showing reduced sensitivity to non-crash events which have longer or shorter impulse durations. Furthermore, the crash-sensing switch of the present invention affords stable and repeatable performance over a broad temperature range, while at the same time being much less costly to manufacture.

In brief, the present invention provides a spring-loaded mass which is supported for movement along an axis. Gas damping is provided by a flat disk supported on the moving mass, which normally engages a mating surface. A seal around the perimeter restricts movement of air into the space between the mating surfaces when an accelerating force is applied to the mass. Leakage into the space permits movement of the mass only if the force is applied over a period of time. When movement exceeds a predetermined amount, the seal is broken and the pressure between the mating surfaces is equalized with the ambient pressure allowing the mass to accelerate and actuate a switch.

DESCRIPTION OF THE DRAWINGS

For a better understanding of the invention, reference should be made to the accompanying drawings, wherein.

DETAILED DESCRIPTION

Figure 1:
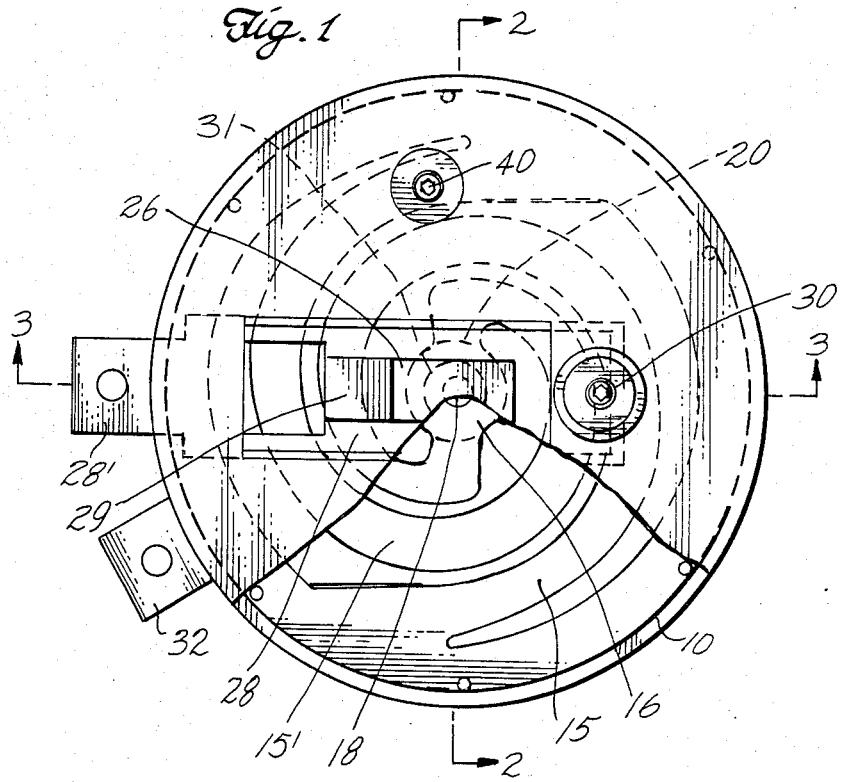
FIG. 1 is a top view partially cut away of the preferred embodiment of the present invention.

Referring to the drawings in detail, the numeral 10 indicates a base made of molded plastic or other rigid or nonconductive material. Supported on the base 10 is a cylindrical cup-shaped cover 12 similarly molded of a suitable plastic or other rigid nonconductive material. The base may be attached or anchored to a vertical, forward-facing surface on an automobile or other vehicle when the unit is used as a crash-sensing device.

Secured to the open end of the cup-shaped cover 12 is a spiral spring 14. As seen in FIG. 1, the disk-shaped spring has two arms 15 and 15' which spiral inwardly to a center portion 16. A central rod 18 has a flange 20 which is secured to the center section 16 of the spring 14. The outer end of the rod 18 slidably engages an oversized bore 22 in the end wall of the cup-shaped cover 12. The spiral spring 14 allows the rod to move along its axis, the flange moving to the dotted position indicated at 20'. The spring applies a restoring force to the rod 18, which resists the movement of the rod 18 and urges the rod back to its normal at-rest position. The rod 18 acts as an inertial mass which moves relative to the base 10 when the base 10 is accelerated or decelerated in a direction parallel to the axis of the rod 18. The spiral spring, in addition to providing a restoring force, operates as a centering means for maintaining axial alignment of the rod 18 with the base 10.

Figure 2:
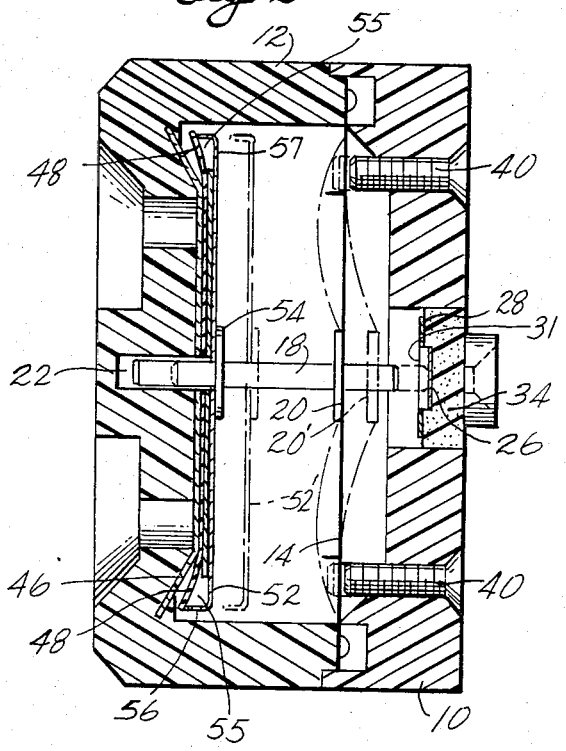
FIG. 2 is a sectional view taken substantially on the line 2—2 of FIG. 1.
Figure 3:
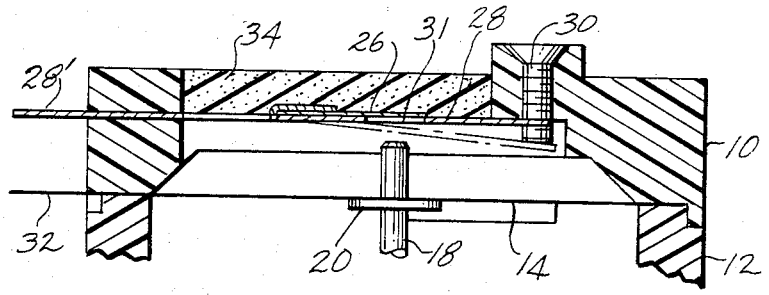
FIG. 3 is a partial sectional view taken substantially on the line 3—3 of FIG. 1.

Movement of the rod 18 to the right, as viewed in FIG. 2, brings the end of the rod 18 into engagement with a spring contact leaf 26. The contact leaf is supported by a flat flexible metal terminal 28. A portion of the terminal is cut out to form a tab 29 that is folded over on top of the leaf 26 to clamp the leaf in place. An opening 31 in the terminal 28 permits the rod 18 to pass through the terminal into contact with the leaf 26. The terminal 28 is molded to the base 10 with one end 28' projecting outside the base to provide an external electrical connection. The other end of the terminal 28 is cantilevered so as to be movable by a calibrating set screw 30 which can be adjusted to deflect the contact leaf 26 toward the end of the rod 18 to reduce the gap between the end of the rod 18 when in its normal position. Thus the distance the rod 18 must move axially to close the gap and make contact with the contact leaf 26 is made adjustable by the set screw 30. A second external contact 32, which is integral with the spiral spring 14, provides an external connection to the rod 18. Thus when the rod 18 comes into contact with the contact leaf 26, an electrical circuit is closed between the external connections 28' and 32. Preferably a piece of foam material, indicated at 34, acts as a dampening material for the contact leaf 26 to eliminate or reduce contact bounce when the rod 18 moves into contact with the contact leaf 26.

The force of the spiral spring 14 can be adjusted by a pair of set screws 40 in the base 10. The set screws 40 are positioned to engage the outer ends of the spiral arms 15 and 15' of the spring 14. When the screws press against the spring, they deflect the spring arms to increase the force applied by the spring against the flange 20 of the rod 18. Thus the setting of the set screws increases the preloading of the spring, which force must be overcome before the rod can move in a direction to engage the leaf contact 26.

In order to achieve the desired characteristics of a crash-sensing switch, movement of the rod to bring it into contact with the leaf contact 26 must be most sensitive to accelerating impulses of a predetermined magnitude and duration. Impulses of greater magnitude but shorter duration, as well as impulses of lesser magnitude but much longer duration, should not result in closing the switch. This desired characteristic is controlled by a gas damping arrangement activated by movement of the rod 18. As shown in FIG. 2, the gas damping arrangement includes a frusto-conical metal disk 46 which is molded into the inner end wall of the cup-shaped cover 12. The disk provides a flat metal surface extending transverse to the axis of the rod 18. The frusto-conical disk 46 is provided with a central hole through which the rod 18 passes into the bore 22. A flexible disk 48 is clamped to the frusto-conical disk 46 by a flat metal keeper disk 50. The keeper disk is preferably spot welded, brazed or otherwise secured to the disk 46 through small openings in the flexible disk 48 so as to clamp the flexible disk with the outer periphery of the flexible disk projecting beyond the outer perimeter of the keeper disk 50.

A damping member 52 is secured to a flange 54 on the rod 18. The damping member is preferably a cup-shaped plate but may be a flat disk or a concial plate. The damping member has an outer periphery that is out of contact with any surrounding structure so that it is free to move without any restraining forces other than viscous damping by the air through which it is moved. The damping member 52 moves with the rod 18 to the dotted position, indicated at 52' when the base is decelerated. In the preferred embodiment, the cup-shaped damping member 52 provides a cylindrical lip 56, which is of slightly larger diameter than the keeper disk 50. A flat central portion of the cup-shaped damper member 52 moves into mating contact with the flat surface of the keeper disk 50 in response to the urging of the spring 14. At the same time, the lip 56 presses against the flexible disk 48 around the outer perimeter, deflecting the flexible disk 48 into the position shown in FIG. 2. A very limited annular air space or ullage 55 is provided between the outer portion of the flexible disk 48, where it extends beyond the keeper disk 50 and the inside of the cup-shaped damper member 52. Substantially all air space is excluded from the space between the mating surfaces of the damping member 52 and keeper disk 50 when they are pressed together by the preloaded force of the spring 14.

In operation, when an accelerating force is applied to the base, causing the base to move toward the end of the rod 18, the damping member 52 and keeper disk 50 want to move apart due to the inertia of the mass represented by the rod 18 and damping member 52. This causes an increase in the volume of air space between the damping member 52 and the flexible disk 48. This increase in volume results in a drop in pressure partial vacuum on the inside of the cup-shaped damping member 52. The resulting pressure differential tends to force the damping member back toward the keeper disk, resisting movement of the damper member 52 and rod 18 in a direction to close the switch. If the accelerating impulse is of sufficient duration, however, air will leak into the space between the damper member 52 and the keeper disk 50 to equalize the pressure and reduce the opposing force on the damper member 52. Leakage may be the result of an imperfect seal between the lip 56 and the flexible disk 48. Leakage of air into the space between the keeper disk 50 and the damper member 52 or the ullage 55 to equalize the pressure across the damper member 52 can be enhanced and controlled by providing one or more small openings 57 in the flexible disk and/or the damper member 52 to permit air to enter at a desired rate. However, if the acceleration impulse is of short duration and of high level, the enclosed volume will increase faster than air can enter the closed space, and a partial vacuum is created momentarily which operates to greatly inhibit the motion of the rod 18. Only if the magnitude of the impulse is very large or the duration of the acceleration is long enough, will the rod move in spite of the pressure differential across the damping member 52. The rod will move against the spring 14 a sufficient distance to move the lip 56 out of engagement with the flexible disk 48. Thus the seal will be broken and the pressure will be almost instantly equalized. The mass of the rod 18 will then move more freely, being resisted only by the restoring force caused by the deflection of the spring 14 and the viscous damping effect of the damper member moving through the surrounding air. The damping member 52 will continue to provide some velocity dependent drag as it is moved through the air. This is a viscous type of damping, similar to the effect experienced by a parachute falling through the air.

Thus the damping arrangement of the present invention allows the device to respond like a substantially undamped spring-loaded inertial mass for low-level, long-duration acceleration impulses but is increasingly damped in its motion as the impulses become shorter. The gas damping effect is dominant for short impulses.

Figure 4:
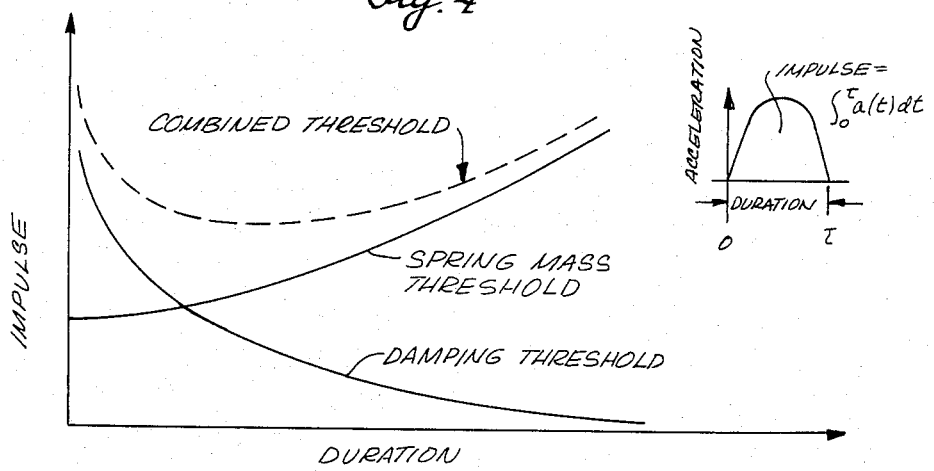
FIG. 4 is a graphical plot of the operating characteristics of the device.

The operating characteristic of the gas-damped switch is shown in FIG. 4, which shows the switching threshold as a function of acceleration impulse duration. As shown, the damping threshold increases as the duration of the impulse shortens. Thus a much higher magnitude of acceleration is required to exceed the threshold for operating the switch for impulses of short duration. On the other hand, the spring mass threshold increases with acceleration impulse duration. By combining the spring mass and damping effect, a combined threshold characteristic is achieved in which the highest sensitivity (smallest acceleration magnitude) is required at an intermediate pulse duration. This effect is very difficult to achieve with present acceleration switch design. This characteristic is important to reduce the switch's sensitivity to sharp impulses, such as those generated by blows from hammers, knocks from rocks or other objects, or impulses from hitting chuck holes or the like. The sensitivity of the switch is also kept low for accelerations of long duration, such as in panic braking. By carefully matching the damping and inertial response of the spring-loaded mass, the region of maximum sensitivity can be made to correspond to the impulse duration experienced in usual crash situations. The time duration of the acceleration impulse in an angular or soft head-on automobile crash has a known range of duration. The cresh-sensing switch can be designed to provide maximum sensitivity for these conditions, while at the same time providing less sensitivity for non-crash events that characteristically have longer or shorter pulse durations.

What is claimed is:

1. An acceleration sensing apparatus comprising: a base, a movable mass, means supporting the mass from the base for movement along an axis, a force generating means urging the mass in one direction along said axis, damping means controlling movement of the mass against the urging of the force generating means, the damping means including a first member secured to the base and a second member secured to the mass, the two members having broad mating surfaces which are normally held in contact by the force generating means, the mating surfaces being moved apart by movement of the mass relative to the base along said axis, the second member comprising a thin plate having an outer periphery out of contact with any surrounding structure, one side of the plate forming said mating surface with the first member, the plate being moved by the mass free of any restraining forces other than viscous damping of any surrounding air.

2. Apparatus of claim 1 further comprising a flexible sealing means around the periphery of one of said first and second members and in contact with the other of said member when the members are moved together for substantially limiting the flow of air into the space formed between the two members with small axial movement of the mass, and means for opening said space between the two members to the surrounding air when movement of the mass relative to the base exceeds said small axial movement so as to freely admit air into the space between the separated surfaces.

3. Apparatus of claim 1 further comprising a switching unit actuated by the mass moving relative to the base along said axis.

4. Apparatus of claim 1 wherein at least one of said first and second members includes a small opening through the member for providing a restricted air passage into and out of the region between said surfaces.

5. Apparatus of claim 1 wherein said second member secured to the mass includes an outer damping surface extending substantially perpendicular to said axis, said outer damping surface pushing against any surrounding air when the mass moves against the urging of the force generating means.

6. Apparatus of claim 2 wherein the sealing means includes a resilient flexible sheet extending around and projecting beyond the perimeter of one of said first and second members, the other of said members having a projecting lip around the perimeter which engages and deflects the flexible sheet when said mating surfaces are in contact.

7. Apparatus of claim 1 wherein said force generating means comprises a spring disk, the mass being secured to the center of the disk and the outer perimeter being secured to the base.

8. Apparatus of claim 7 wherein the mass includes a rod extending perpendicular to the spring disk, said second member being secured to the rod in spaced parallel relation to the disk.

9. Apparatus of claim 8 wherein a switch contact is mounted on the base in line with the rod, the end of the rod engaging the contact when the rod moves axially against the urging of the spring disk a predetermined distance.

10. Apparatus of claim 9 further including means for adjusting the spacing between the rod and the contact to vary said predetermined distance.

11. Apparatus of claim 9 further including means engaging the spring disk adjacent the outer perimeter of the spring disk for deflecting the disk in a direction to move the rod away from the contact.

12. A crash sensor for automobiles and other types of vehicles comprising:

a housing having a gas-filled chamber, a force generating means attached to the housing and extending into the chamber, force transmitting means secured to the force generating means, means supporting the force transmitting means in the chamber for movement along a longitudinal axis against the urging of the force generating means, switching means actuated by movement of the force transmitting means a predetermined distance along said axis, a damping member secured to the force transmitting means within the chamber, the damping member having a broad flat surface extending substantially transverse to said longitudinal axis, means secured to the housing forming a fixed broad flat surface normally held in contact with said flat surface of the damping member by the urging of the force generating means, and flexible sealing means extending around the periphery of said surfaces for restricting the flow of air into the space between the surfaces when the surfaces are slightly separated by movement of the force transmitting means toward the switching means.

13. Apparatus of claim 12 wherein the flexible sealing means comprises a flat flexible membrane projecting beyond the perimeter of one of said flat surfaces, and the other of said surfaces having a projecting ridge around the periphery, the ridge engaging and deflecting the membrane when the two surfaces are moved into contact with each other, the ridge disengaging from the membrane when the surfaces are moved apart more than a predetermined distance.

14. Apparatus of claim 12 wherein said predetermined distance is less than the distance the force transmitting means moves to actuate the switching means.

* * * * *